US007490423B2

(12) United States Patent
Zhang et al.

(10) Patent No.: US 7,490,423 B2
(45) Date of Patent: Feb. 17, 2009

(54) ELECTRIC IRON

(75) Inventors: Tao Zhang, Guangzhou (CN); Toyohiko Yagi, Osaka-fu (JP); Mingkun Ye, Guangzhou (CN); Runlong Xu, Guangzhou (CN)

(73) Assignees: Panasonic Corporation, Osaka (JP); Panasonic Wanbao Home Appliances Electric Iron (Guangzhou) Co., Ltd., Guangzhou (CN)

( * ) Notice: Subject to any disclaimer, the term of this patent is extended or adjusted under 35 U.S.C. 154(b) by 0 days.

(21) Appl. No.: 11/311,157

(22) Filed: Dec. 20, 2005

(65) Prior Publication Data

US 2006/0156592 A1 Jul. 20, 2006

(30) Foreign Application Priority Data

Dec. 20, 2004 (CN) ..... 2004 1 0077466

(51) Int. Cl.
*D06F 75/38* (2006.01)
*D06F 75/30* (2006.01)

(52) U.S. Cl. ..... 38/93

(58) Field of Classification Search ..... 38/74, 38/77.5, 77.8, 77.83, 80, 81, 88, 93, 97; 219/245
See application file for complete search history.

(56) References Cited

U.S. PATENT DOCUMENTS 222,849 A * 12/1879 Welch ..... 38/93
1,768,145 A * 6/1930 Raditsch ..... 126/411
1,859,167 A * 5/1932 Prenzel ..... 38/93
2,449,111 A * 9/1948 Foster ..... 69/20
2,451,984 A * 10/1948 Shapiro ..... 69/20
2,708,801 A * 5/1955 Voskresenski ..... 38/77.83
2,729,004 A * 1/1956 Swanson ..... 38/93
2,764,825 A * 10/1956 Coyne ..... 38/93
2,906,043 A * 9/1959 Jepson et al. ..... 38/77.7
4,658,520 A * 4/1987 Henneberger et al. ..... 38/93
5,592,763 A * 1/1997 Hahnewald et al. ..... 38/77.9
5,799,422 A * 9/1998 Demuth et al. ..... 38/93
6,189,245 B1 * 2/2001 Louison et al. ..... 38/93
6,216,369 B1 * 4/2001 Wolf et al. ..... 38/93
6,820,359 B2 * 11/2004 Muljadi ..... 38/93

FOREIGN PATENT DOCUMENTS

CN 1370886 9/2002
JP 48-28073 8/1973
JP 2002-239299 8/2002

* cited by examiner

*Primary Examiner*—Ismael Izaguirre
(74) *Attorney, Agent, or Firm*—Wenderoth, Lind & Ponack, L.L.P.

(57) ABSTRACT

This invention relates to a kind of electric iron for eliminating wrinkles from clothes and other materials. The electric iron has an ironing seat, which is composed of a soleplate, an ironing surface on the soleplate, and a heater that heats the soleplate. There are heater-shaped dented portions on the ironing surface where the heater is installed. This invention, with this structure, reduces a contacting area between the ironing surface close to the heater and clothes or other materials to be ironed, thus changing an uneven distribution of temperature on the ironing surface. Further, for a steam electric iron, steam sprayed out of steam outlets in a soleplate spreads to areas away from a heater through dented portions, thereby resulting in an effect of wrinkle elimination.

19 Claims, 11 Drawing Sheets

ELECTRIC IRON

TECHNICAL FIELD

The present invention relates to a kind of electric iron for eliminating wrinkles from clothes and other materials.

BACKGROUND OF THE INVENTION

For an ironing seat of existing electric irons, a heating temperature in an area close to a heater on an ironing surface attached to a soleplate is higher than areas away from the heater, due to structure of the soleplate and a shape of the heater. As a result, the heating temperature on the ironing surface in its entirety is not even. For these existing steam electric irons, steam flow is also irregular. Thus, it is hard to achieve an excellent ironing effect with the existing electric irons.

SUMMARY OF THE INVENTION

A purpose of this invention is to resolve the above-mentioned problems and provide a kind of electric iron that is free from shortcomings of the existing electric irons.

The following is a technical aspect of this invention: an electric iron has an ironing seat, which is composed of a soleplate, ironing surface on the soleplate, and heater that heats the soleplate; there are dented portions on the ironing surface of the soleplate where the heater is installed, and the dented portions are distributed according to a shape of the heater.

The dented portions are radially distributed from a center line of a heater's projection on the ironing surface to one side or both sides of the center line. In response to a direction of this radial distribution, a caliber of the dented portions changes from big to small, or their depth changes from big to small, or both of these features are incorporated.

A purpose of the dented portions is to reduce a contacting area between the ironing surface close to the heater and clothes or other materials to be ironed, and then reduce an uneven distribution of temperature on the ironing surface, and guide steam that a steam electric iron sprays, thereby resulting in an excellent effect of wrinkle elimination. Therefore, each dented portion may have no less than one pit or groove, or a combination of a pit and groove.

This invention, with this structure, reduces the contacting area between the ironing surface close to the heater and the clothes or other materials to be ironed, thus effectively changing an uneven distribution of temperature on the ironing surface. Further, for a steam electric iron, steam sprayed out of steam outlets in the soleplate spreads to areas away from the heater through the dented portions, resulting in an excellent effect of wrinkle elimination.

DETAILED DESCRIPTION OF THE PREFERRED EMBODIMENTS

Figure 1:
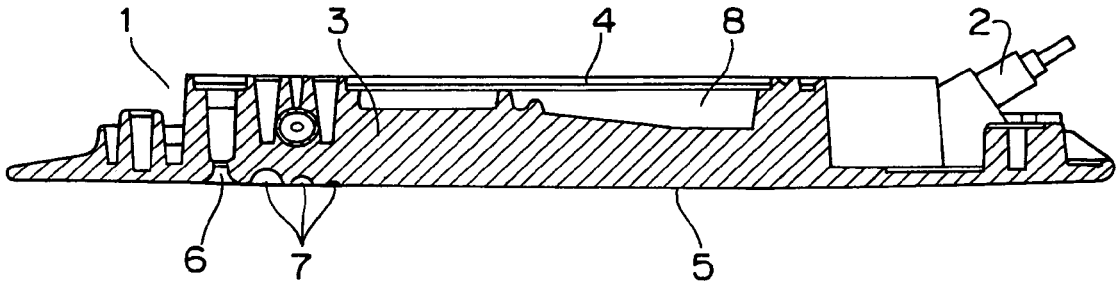
FIG. 1 shows a cutaway view of an ironing seat of an electric iron in Embodiment 1 of this invention.
Figure 2:
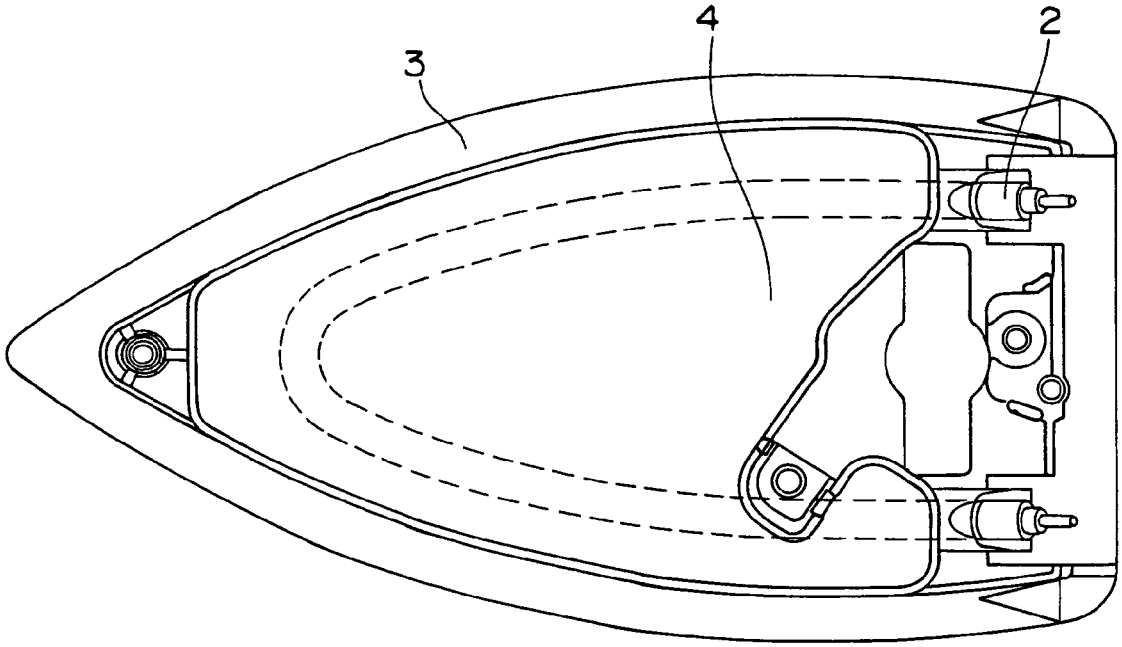
FIG. 2 shows a planform of the ironing seat of the electric iron in Embodiment 1 of this invention.
Figure 3:
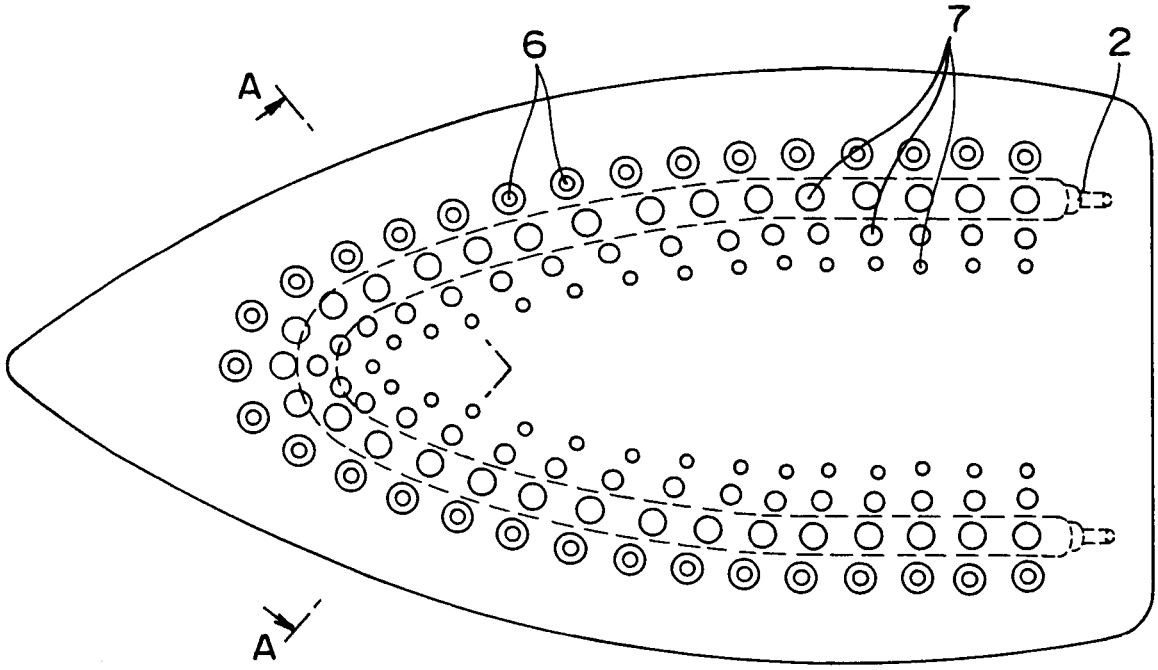
FIG. 3 shows a bottom view of the ironing seat of the electric iron in Embodiment 1 of this invention.
Figure 4:
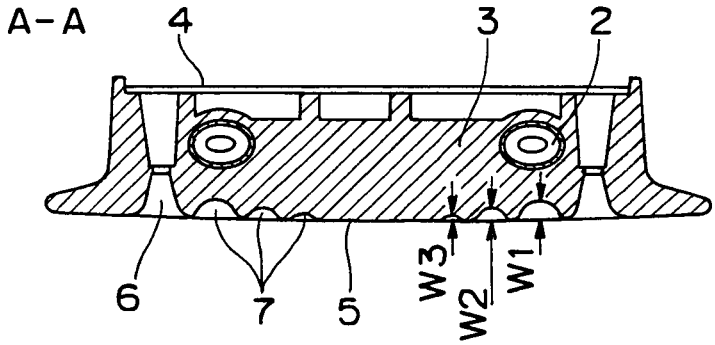
FIG. 4 shows an A-A cutaway view of FIG. 3.

Below are further explanations of this invention with the attached drawings and embodiments.

Embodiment 1

As FIGS. 1-4 show, an ironing seat 1 of this invention is composed of a soleplate 3, which is heated by heater 2, and a cover 4, which covers the soleplate 3. The heater 2 is embedded in aluminum soleplate 3 with outstanding heat conductivity when it is molded. A surface of soleplate 3 is a curved face, which forms an ironing surface 5 after polishing and treatment with a fluoresin coating. In the ironing surface 5, there are multiple steam outlets 6 and multiple dented portions along embedded heater 2, with the steam outlets 6 and dented portions being arranged in an arrangement similar to a shape of the heater 2. Each dented portion is composed of a group of pits, which includes three pits 7. Each group of pits is aligned with a steam outlet 6, and are radially distributed from a center line of a heater's projection on the ironing surface to inside of the center line, namely, a central area of the ironing surface. Meanwhile, a caliber and depth of the pits change from big to small (W1>W2>W3). The caliber of the pit on a center of the heater's projection has a largest caliber and depth. There is no pit in a center and rear end of the ironing surface along a predetermined length in a longitudinal direction of the electric iron. Also, a rear end part has a dent-free area where there is no pit across a full width of the ironing surface.

In one example, dimensions of W1, W2 and W3 are 4.5 mm, 3.5 mm and 2.5 mm, respectively; each dented portion is arranged with a pitch of 6 mm; and a distance between the center line of the heater's projection on the ironing surface and a smallest pit is 12 mm.

A steam chamber 8 on the soleplate evaporates water from a water tank (not shown in the drawings) above the ironing seat 1 and produces steam. The steam chamber 8 is covered with cover 4, and the steam that the steam chamber 8 produces sprays out of a steam outlet. Since the ironing surface 5 is a curved face, there is a gap between the ironing surface and a cloth to be ironed. Thus, after being sprayed from steam outlet 6, the steam can enter the dented portions easily and will spread to a central area of the ironing surface along the dented portions (each group of pits). When the steam enters the pits, the ironing surface 5 can move smoothly. When the heater 2 is electrified, it heats and a temperature of the ironing surface rises. The pits reduce a contacting surface between the ironing surface close to the heater and clothes to be ironed. There is not any pit in the central area and the rear end of the ironing surface, which is away from the heater. As mentioned above, a volume and an inner-surface area of a part near the heater 2 of the dented portion in which air and steam having a lower temperature than that of the ironing surface 5 can be accumulated is enlarged, or a projection area on the ironing surface 5 of the part near the heater 2 of the dented portion is enlarged. Thus, a temperature of the ironing surface in its entirety is roughly even. By providing the dented portions, steam which escapes out of the ironing surface 5 immediately, if there are no dented portions on the ironing surface, can be held within the dented portions. Therefore, portions of a cloth corresponding to the dented portions are fully swelled, and the dented portions can enhance an effect of wrinkle elimination. Further since the dented portions do not exist at the central part and the rear end of the ironing surface 5, the central part and the rear end can press the cloth strongly. Thus, the cloth can fully be dried and finished without wrinkle. At this time, since there are a plurality of rows of the dented portions and they are formed from big to small as mentioned above, an amount of steam held in the dented portions can be decreased gradually. Also, since there are no dented portions at the rear end part, which applies finishing touches to the cloth during ironing, of the ironing surface 5, the rear end part contributes to making the cloth fully dry and finishing the cloth smoothly. As a result, smoothness of the ironing surface and an effect of wrinkle elimination can be improved.

Embodiment 2

Figure 5:
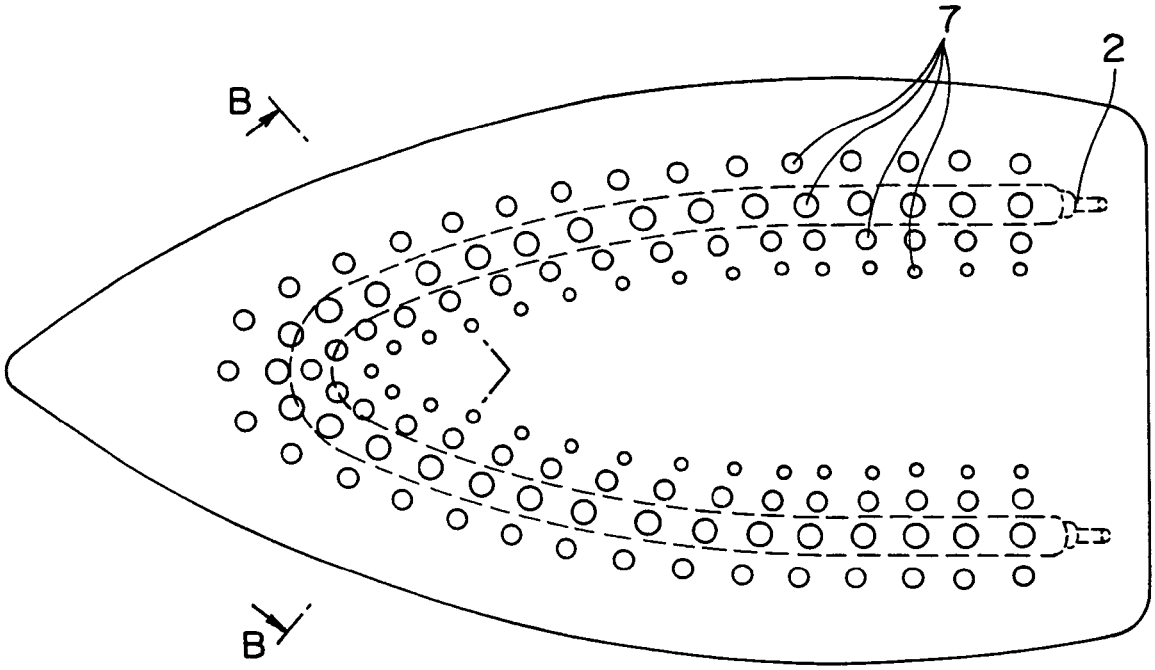
FIG. 5 shows a bottom view of an ironing seat of an electric iron in Embodiment 2 of this invention.
Figure 6:
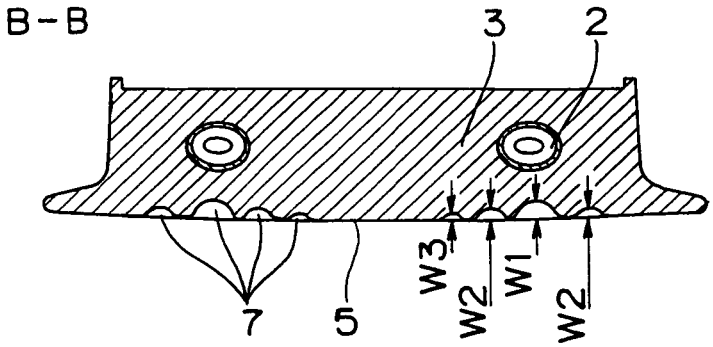
FIG. 6 shows a B-B cutaway view of FIG. 5.

FIG. 5 and FIG. 6 show an ironing seat of a dry electric iron. Heater 2 is buried in soleplate 3, whose surface forms ironing surface 5. There are multiple dented portions on the ironing surface 5 where the heater is embedded, and each dented portion is composed of a group of pits, which includes four pits 7. Each group of pits is radially distributed from a center line of a heater's projection on the ironing surface to both sides of the center line of the heater's projection. Meanwhile, a caliber and depth of the pits change from big to small (W1>W2>W3). The caliber of the pit in the heater's projection center has a largest caliber and depth. There is no pit in a center and rear end of the ironing surface along a predetermined length in a longitudinal direction of the electric iron. Also, the rear end part has a dent-free area where there is no pit across a full width of the ironing surface.

Other effects of this embodiment are similar to those of Embodiment 1.

Embodiment 3

Figure 7:
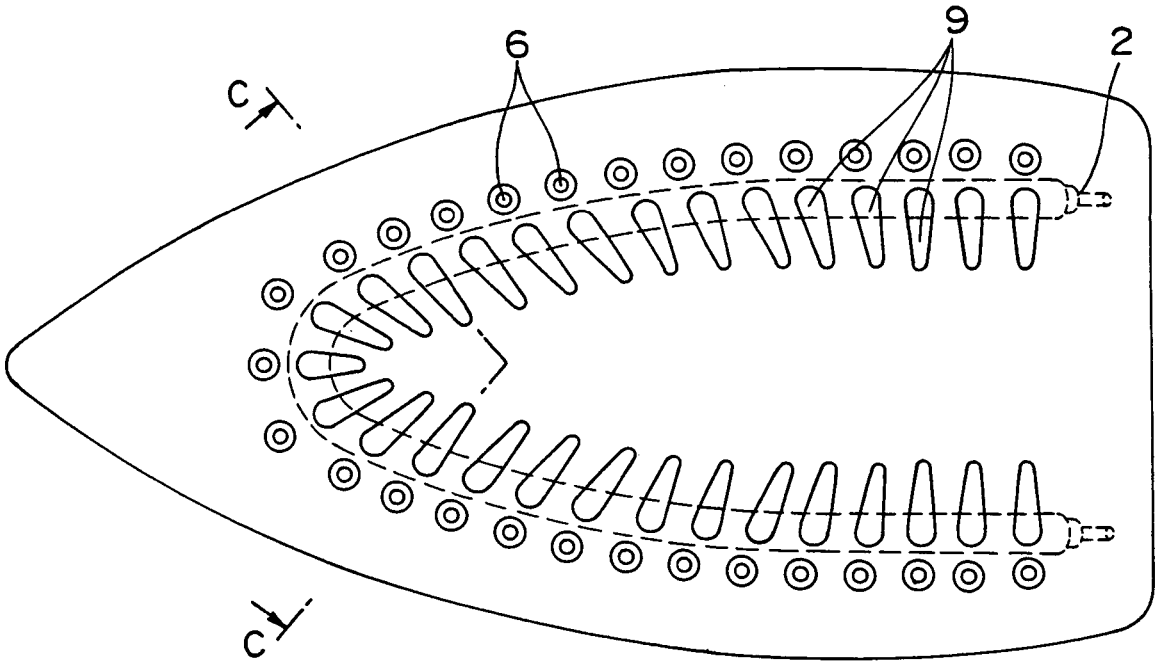
FIG. 7 shows a bottom view of an ironing seat of an electric iron in Embodiment 3 of this invention.
Figure 8:
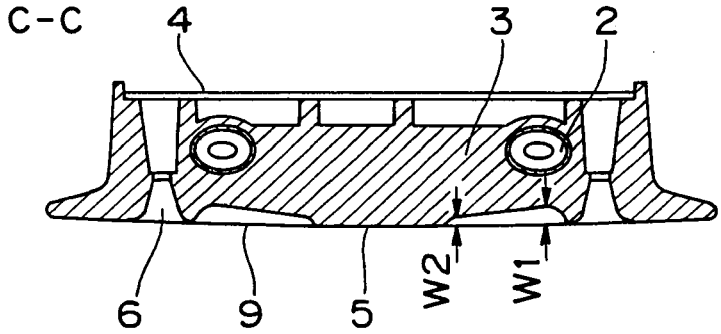
FIG. 8 shows a C-C cutaway view of FIG. 7.

As FIG. 7 and FIG. 8 show, heater 2 is buried in soleplate 3, whose surface forms ironing surface 5. Soleplate 3 is covered with cover 4. There are multiple steam outlets 6 and multiple dented portions on the ironing surface 5 where the heater is embedded, and each dented portion is a groove 9. Each groove 9 is aligned with a steam outlet 6, and extends radially from a center line of a heater's projection on the ironing surface to inside of the heater's projection center line, namely, a central area of the ironing surface. A caliber and depth of the grooves change from big to small (W1>W2). Other structures of this embodiment are similar to those of Embodiment 1.

Each groove 9 reduces a contacting area between the ironing surface and clothes to be ironed, and spreads steam to a center of the ironing surface. Flow of steam in the groove enables the ironing surface to move smoothly, to achieve the effects of Embodiment 1.

Embodiment 4

Figure 9:
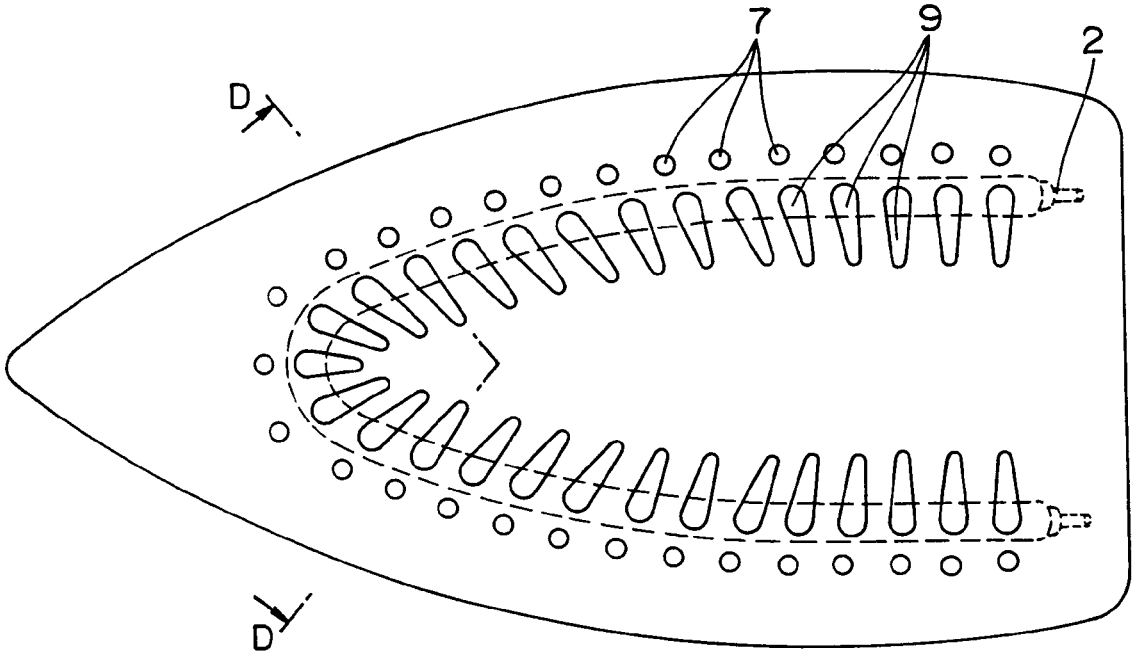
FIG. 9 shows a bottom view of an ironing seat of an electric iron in Embodiment 4 of this invention.
Figure 10:
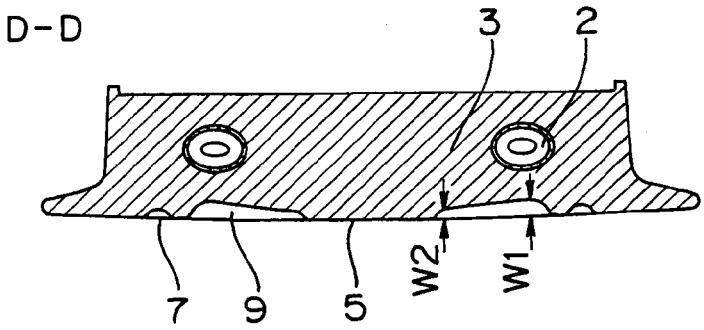
FIG. 10 shows a D-D cutaway view of FIG. 9.

FIG. 9 and FIG. 10 show an ironing seat of a dry electric iron. Different from Embodiment 3, this ironing seat doesn't have a steam chamber cap (cover), steam chamber or steam outlet. On ironing surface 5 on soleplate 3 where a heater is embedded, there are multiple grooves 9. Each groove 9 extends radially from a center line of a heater's projection on the ironing surface to inside of the center line of the heater's projection, namely, a central area of the ironing surface. A caliber and depth of the grooves change from big to small. There are pits 7 corresponding to grooves 9, respectively. Compared with the grooves 9 in a center of the heater's projection, pits 7 have a smaller mouth width and depth. Other structures of this embodiment are similar to those of Embodiment 2.

Effects of this embodiment are similar to those of Embodiment 2.

Embodiment 5

Figure 11:
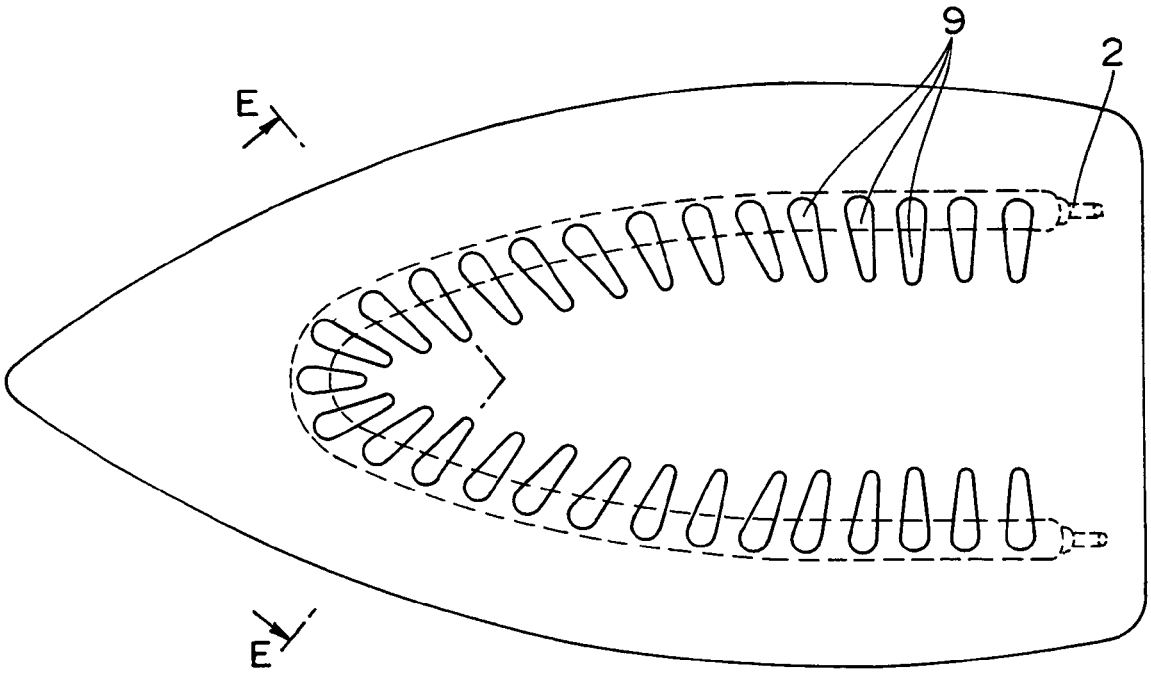
FIG. 11 shows a bottom view of an ironing seat of an electric iron in Embodiment 5 of this invention.
Figure 12:
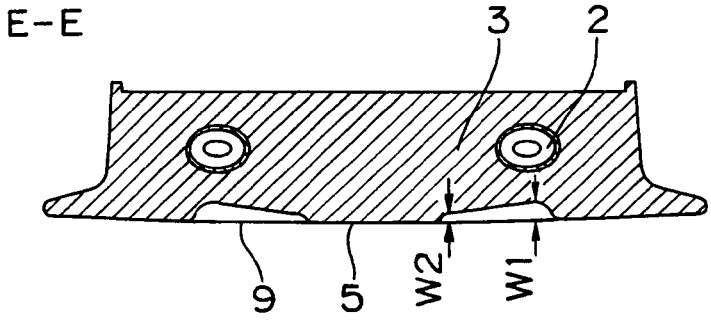
FIG. 12 shows an E-E cutaway view of FIG. 11.

FIG. 11 and FIG. 12 show an ironing seat of a dry electric iron. Different from Embodiment 4, there are not any pits outside a center line of a heater's projection on an ironing surface. Other structures are similar to those of Embodiment 4.

Effects of this embodiment are similar to those of Embodiment 4.

Embodiment 6

Figure 13:
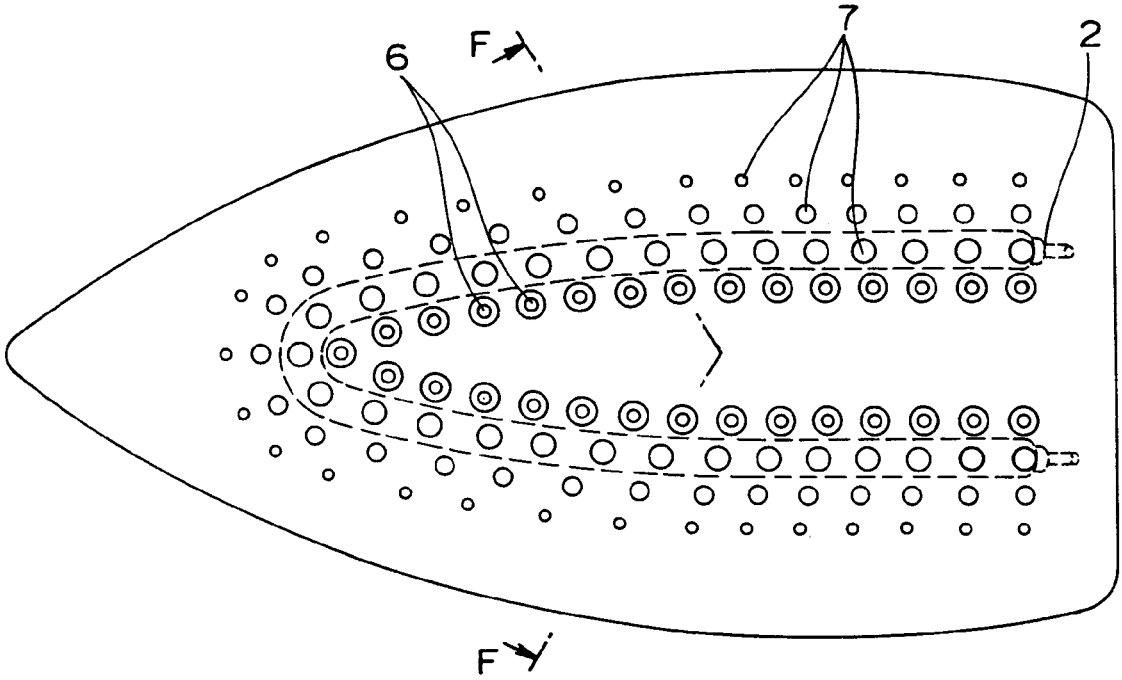
FIG. 13 shows a bottom view of an ironing seat of an electric iron in Embodiment 6 of this invention.
Figure 14:
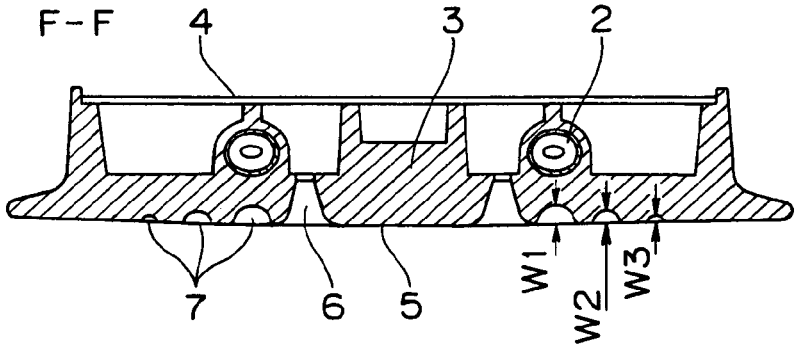
FIG. 14 shows an F-F cutaway view of FIG. 13.

As FIGS. 13 and 14 show, heater 2 is buried in a central part of soleplate 3. There are multiple steam outlets 6 and multiple dented portions on ironing surface 5 where the heater is embedded, and each dented portion is composed of a group of pits, which includes three pits 7. Each group of pits is aligned with a steam outlet 6, and extends radially from a center line of a heater's projection on the ironing surface to outside of the center line, namely, a marginal area of the ironing surface. A caliber and depth of the pits change from big to small (W1>W2>W3). The caliber of the pit in a center of the heater's projection has a largest caliber and depth. Other structures of this embodiment are similar to those of Embodiment 1.

The steam outlets and pits close to the heater on the ironing surface reduce a contacting area between a high-temperature ironing surface and clothes to be ironed. Further, steam spreads outwards from the pits, thereby enabling the ironing surface to move smoothly, thus achieving the same effects as those of Embodiment 1.

Embodiment 7

Figure 15:
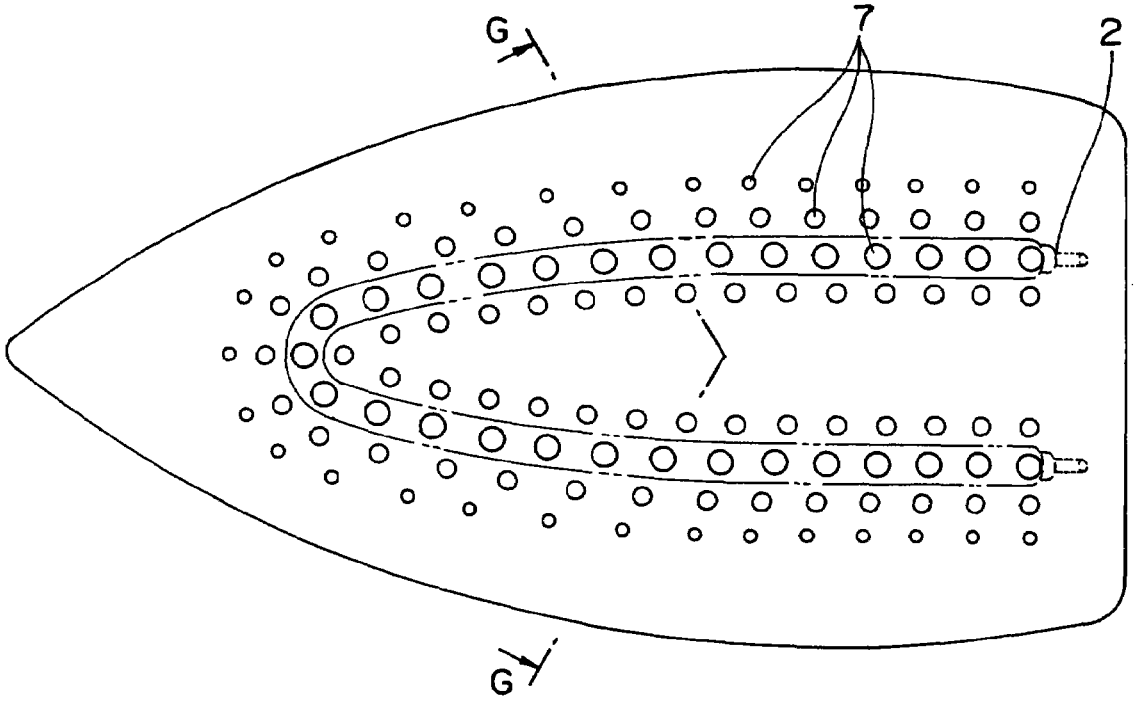
FIG. 15 shows a bottom view of an ironing seat of an electric iron in Embodiment 7 of this invention.
Figure 16:
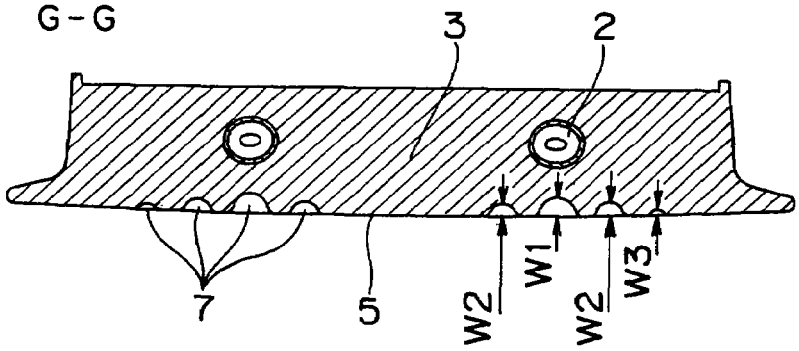
FIG. 16 shows a G-G cutaway view of FIG. 15.

FIG. 15 and FIG. 16 show an ironing seat of a dry electric iron. Heater 2 is buried in a central part of soleplate 3, whose surface forms ironing surface 5. There are multiple dented portions on the ironing surface 5 where the heater is embedded, and each dented portion is composed of a group of pits, which include four pits 7. Each group of pits is radially distributed from a center line of a heater's projection on the ironing surface to both sides of the center line. Meanwhile, a caliber and depth of the pits change from big to small (W1>W2>W3). The caliber of the pit in a center of the heater's projection has a largest caliber and depth.

Effects of this embodiment are similar to those of Embodiment 1.

Embodiment 8

Figure 17:
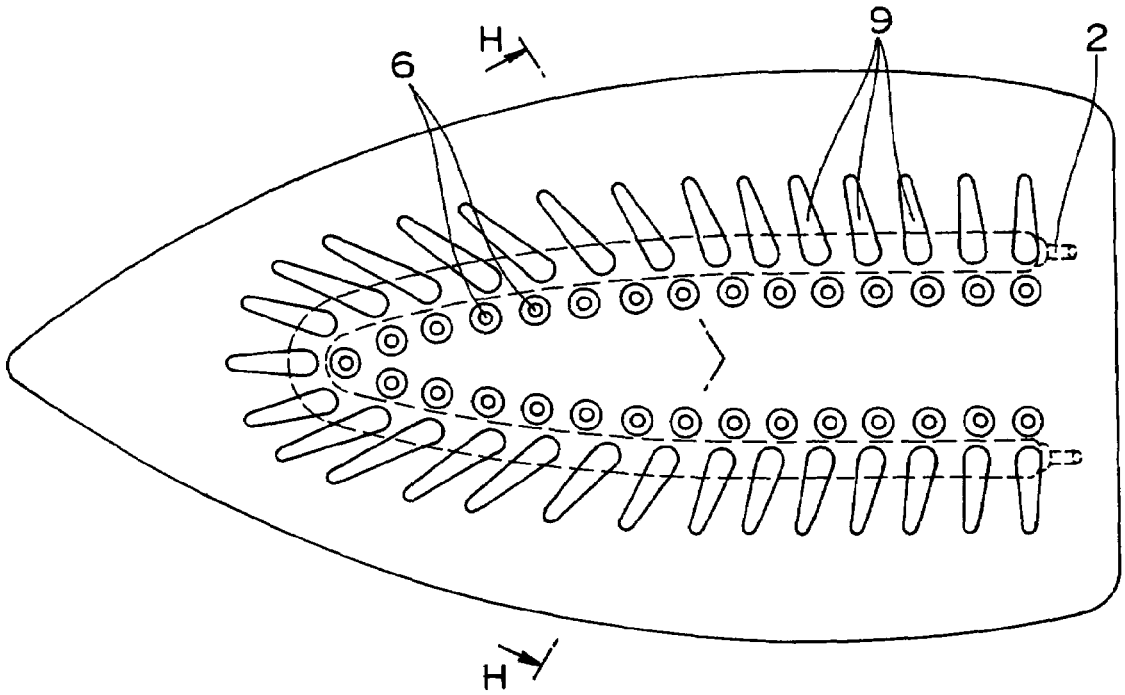
FIG. 17 shows a bottom view of an ironing seat of an electric iron in Embodiment 8 of this invention.
Figure 18:
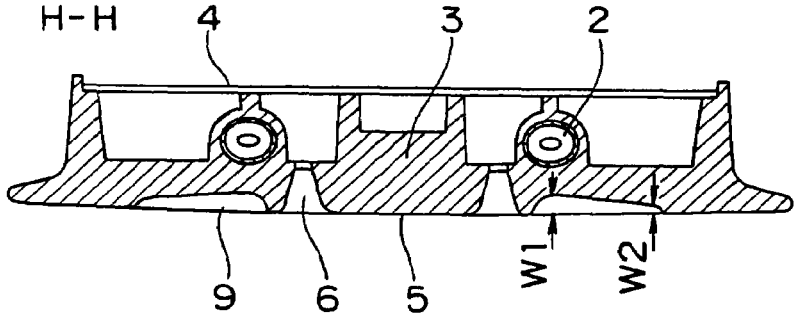
FIG. 18 shows an H-H cutaway view of FIG. 17.

As FIG. 17 and FIG. 18 show, heater 2 is buried in a central part of soleplate 3, whose surface forms ironing surface 5. There are multiple steam outlets 6 and multiple grooves 9 on the ironing surface 5 where the heater is embedded, and each groove 9 is aligned with a steam outlet 6, and extends radially from a center line of a heater's projection on the ironing surface to outside of the center line, namely, a marginal area of the ironing surface. A caliber and depth of the grooves change from big to small. Other structures of this embodiment are similar to those of Embodiment 6.

The grooves, close to the heater, on the ironing surface reduce a contacting area between a high-temperature ironing surface and clothes to be ironed. Further, the grooves enable steam to spread outwards, thereby allowing the ironing surface to move smoothly, thus achieving the same effects as those of Embodiment 1.

Embodiment 9

Figure 19:
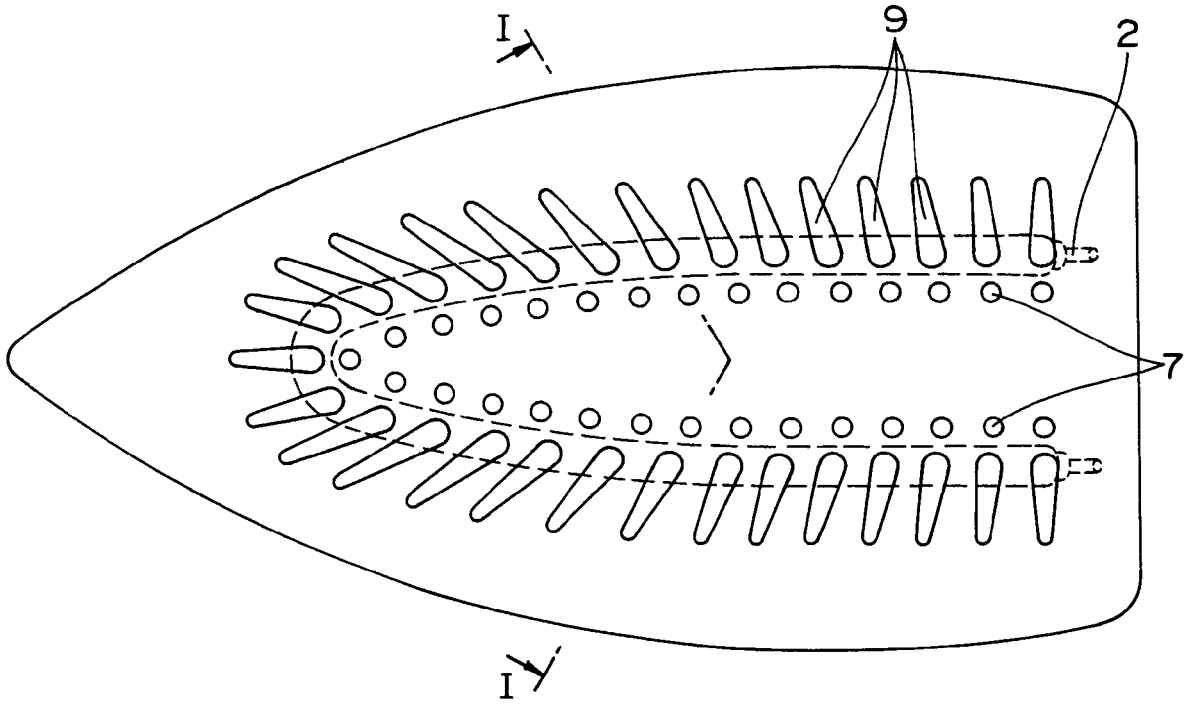
FIG. 19 shows a bottom view of an ironing seat of an electric iron in Embodiment 9 of this invention.
Figure 20:
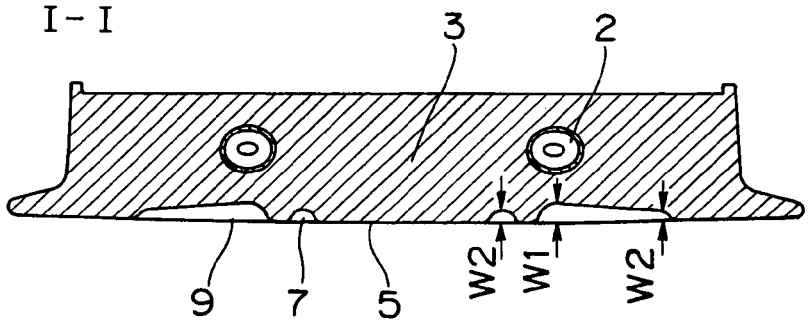
FIG. 20 shows an I-I cutaway view of FIG. 19.

FIG. 19 and FIG. 20 show an ironing seat of a dry electric iron. Heater 2 is buried in a central part of soleplate 3, whose surface forms ironing surface 5. There are multiple grooves 9 on the ironing surface 5 where the heater is embedded, and each groove 9 extends radially from a center line of a heater's projection on the ironing surface to outside of the center line, namely, a marginal area of the ironing surface. A caliber and depth of the grooves change from big to small. Inside the center line of the heater's projection, there is a pit 7 corresponding to groove 9. Compared with the grooves 9 in a central part, pits 7 have a smaller mouth width and depth.

Effects of this embodiment are similar to those of Embodiment 1.

Embodiment 10

Figure 21:
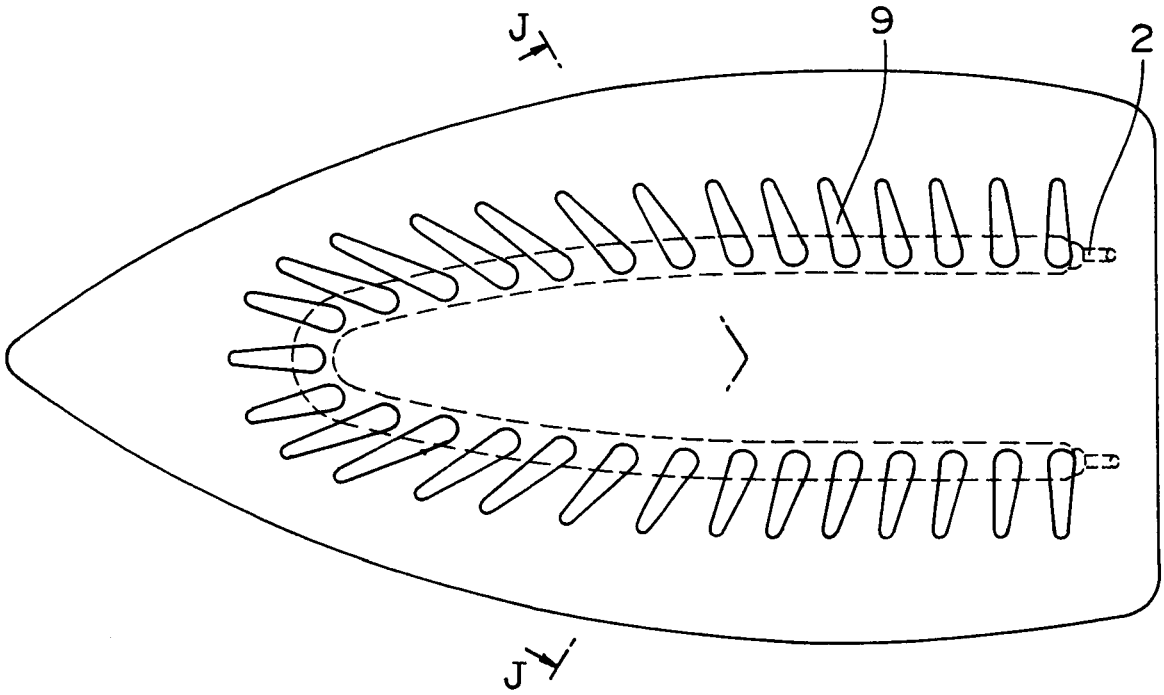
FIG. 21 shows a bottom view of an ironing seat of an electric iron in Embodiment 10 of this invention.
Figure 22:
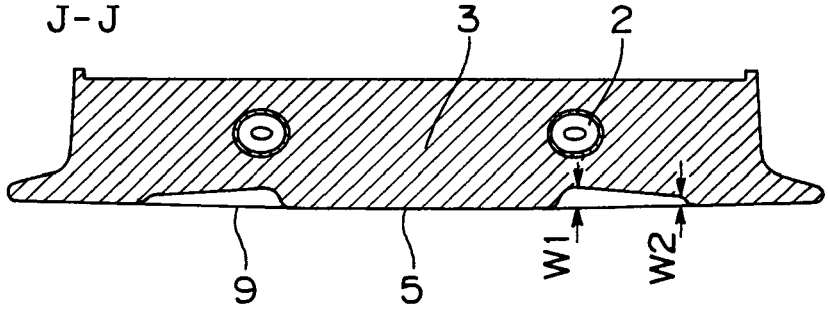
FIG. 22 shows a J-J cutaway view of FIG. 21.

FIG. 21 and FIG. 22 show an ironing seat of a dry electric iron. Different from Embodiment 9, there is not any pit inside a center line of a projection of a heater on an ironing surface. Other structure is the same as that of Embodiment 9.

It is to be noted that, by properly combining arbitrary embodiments of the aforementioned various embodiments, effects possessed thereby can be produced.

Although the present invention has been fully described in connection with preferred embodiments thereof with reference to the accompanying drawings, it is to be noted that various changes and modifications are apparent to those skilled in the art. Such changes and modifications are to be understood as included within the scope of the present invention as defined by the appended claims unless they depart therefrom.

The disclosure of Chinese Patent Application No. 200410077466.8 filed on Dec. 20, 2004, including specification, claims, drawings, and summary is incorporated herein by reference in its entirety.

What is claimed is:

1. An electric iron comprising:

an ironing seat including a soleplate defining an ironing surface, and a heater for heating said soleplate; and steam outlets on said ironing surface, wherein dented portions are on said ironing surface and arranged in a configuration such that said dented portions are positioned on at least one side of a line passing through a front end and a rear end of said ironing surface, with none of said dented portions having a steam outlet positioned therein, and wherein said heater has a shape that corresponds to said configuration in which said dented portions are arranged.

2. The electric iron according to claim 1, wherein each of said dented portions includes at least one of (i) at least one pit, and (ii) at least one groove.

3. The electric iron according to claim 2, wherein said at least one pit is one of circular and oval.

4. The electric iron according to claim 1, wherein a central part of said ironing surface is free from any dented portion.

5. The electric iron according to claim 4, wherein said central part of said ironing surface is one of planar and curved.

6. The electric iron according to claim 1, wherein a rear part of said ironing surface, extending for a full width of said ironing surface, is free from any dented portion.

7. The electric iron according to claim 6, wherein said rear part of said ironing surface is one of planar and curved.

8. The electric iron according to claim 1, wherein said dented portions are arranged in said configuration such that said dented portions are positioned on both sides of the line passing through the front end and the rear end of said ironing surface.

9. An electric iron comprising:

an ironing seat including a soleplate defining an ironing surface, and a heater for heating said soleplate;

wherein dented portions are on said ironing surface and arranged in a configuration such that said dented portions are positioned on at least one side of a line passing through a front end and a rear end of said ironing surface, with none of said dented portions having a steam outlet positioned therein, wherein said heater has a shape that corresponds to said configuration in which said dented portions are arranged, and wherein each of said dented portions extend in a direction away from the line passing through the front end and the rear end of said ironing surface, with said each of said dented portions having a width and a depth, and with at least one of (i) said width of said each of said dented portions changing in the direction away from the line passing through the front end and the rear end of said ironing surface, and (ii) said depth of said each of said dented portions changing in the direction away from the line passing through the front end and the rear end of said ironing surface.

10. The electric iron according to claim 9, further comprising:

steam outlets on said ironing surface.

11. The electric iron according to claim 1, wherein each of said dented portions includes at least one of (i) at least one pit, and (ii) at least one groove.

12. The electric iron according to claim 11, wherein said at least one pit is one of circular and oval.

13. The electric iron according to claim 1, wherein a central part of said ironing surface is free from any dented portion.

14. The electric iron according to claim 13, wherein said central part of said ironing surface is one of planar and curved.

15. The electric iron according to claim 1, wherein a rear part of said ironing surface, extending for a full width of said ironing surface, is free from any dented portion.

16. The electric iron according to claim 15, wherein said rear part of said ironing surface is one of planar and curved.

17. The electric iron according to claim 1, wherein said dented portions are arranged in said configuration such that said dented portions are positioned on both sides of the line passing through the front end and the rear end of said ironing surface.

18. An electric iron comprising:

an ironing seat including a soleplate defining an ironing surface, and a heater for heating said soleplate, wherein dented portions are on said ironing surface and arranged in a configuration such that said dented portions are positioned on at least one side of a line passing through a front end and a rear end of said ironing surface with none of said dented portions having a steam outlet positioned therein, and wherein each of said dented portions extend in a direction away from the line passing through the front end and the rear end of said ironing surface, with said each of said dented portions having a width and a depth, and with at least one of (i) said width of said each of said dented portions changing in the direction away from the line passing through the front end and the rear end of said ironing surface, and (ii) said depth of said each of said dented portions changing in the direction away from the line passing through the front end and the rear end of said ironing surface.

19. The electric iron according to claim 18, further comprising:

steam outlets on said ironing surface.

* * * * *